US010228219B2

(12) United States Patent
Boyer et al.

(10) Patent No.: US 10,228,219 B2
(45) Date of Patent: Mar. 12, 2019

(54) UNIVERSAL WEAPON ZEROING TARGET

(71) Applicants: Thomas R. Boyer, Gambrills, MD (US); Isabel C. Fleckenstein, Crofton, MD (US)

(72) Inventors: Thomas R. Boyer, Gambrills, MD (US); Isabel C. Fleckenstein, Crofton, MD (US); Jason Falla, Chesapeake, VA (US)

( * ) Notice: Subject to any disclaimer, the term of this patent is extended or adjusted under 35 U.S.C. 154(b) by 0 days.

(21) Appl. No.: 15/615,807

(22) Filed: Jun. 6, 2017

(65) Prior Publication Data

US 2017/0350678 A1 Dec. 7, 2017

Related U.S. Application Data

(60) Provisional application No. 62/345,864, filed on Jun. 6, 2016.

(51) Int. Cl.
*F41G 1/54* (2006.01)
*F41J 2/00* (2006.01)
*F41J 1/00* (2006.01)

(52) U.S. Cl.
CPC . *F41J 2/00* (2013.01); *F41J 1/00* (2013.01); *F41G 1/54* (2013.01); *F41G 1/545* (2013.01)

(58) Field of Classification Search
CPC ..... F41G 1/54; F41G 1/36; F41J 1/00; F41J 1/01
USPC ..... 273/409; 434/19
See application file for complete search history.

(56) References Cited

U.S. PATENT DOCUMENTS 4,405,132 A 9/1983 Thalmann
5,181,719 A * 1/1993 Cleveland, III ..... F41J 1/00 273/409
5,918,590 A 7/1999 Burkett et al.
6,007,429 A * 12/1999 Lubniewski ..... F41J 5/02 273/371
6,020,040 A 2/2000 Cramer et al.
6,051,840 A 4/2000 Henderson
6,337,475 B1 1/2002 Migliorini
6,767,015 B1 7/2004 Parsley
7,528,397 B2 5/2009 Boyer
7,667,213 B1 2/2010 Schoppman et al.
7,712,225 B2 * 5/2010 Sammut ..... F41G 1/54 273/409
7,820,969 B2 10/2010 Guinn et al.
9,341,444 B2 5/2016 Levine et al.
2002/0009694 A1 * 1/2002 Rosa ..... F41A 33/02 434/16
2011/0175292 A1 * 7/2011 Carni ..... F41J 2/02 273/348.1
2012/0175522 A1 * 7/2012 Boyer ..... F41G 1/36 250/340

(Continued)

*Primary Examiner* — Mark Graham
(74) *Attorney, Agent, or Firm* — Doster Greene, LLC

(57) ABSTRACT

Before a person can use any weapon, such as a gun or a rifle, effectively, the sight must be aligned to the barrel through a zeroing process. An improved zero target is developed which is inexpensive and applicable to many different weapon sight scenarios. By making a universal zero target, users need only a single target eliminating the need for procuring and storing various targets. Additionally, the multi-sight target eliminates the need for field expedient zeroing solutions. The product saves both time and money and improves the results for weapon users.

21 Claims, 5 Drawing Sheets

(56) References Cited

U.S. PATENT DOCUMENTS

| | | | | |
|---|---|---|---|---|
| 2014/0054860 | A1* | 2/2014 | Phipps, Jr. | F41J 1/00 273/409 |
| 2015/0048572 | A1* | 2/2015 | Hochschild, III | F41J 2/00 273/350 |
| 2015/0233683 | A1* | 8/2015 | Phipps, Jr. | F41J 1/00 273/409 |
| 2015/0377588 | A1* | 12/2015 | Periard | F41G 3/326 434/22 |

* cited by examiner

Figure 1
(Prior Art)

25 METERS ZEROING TARGET
M16A2

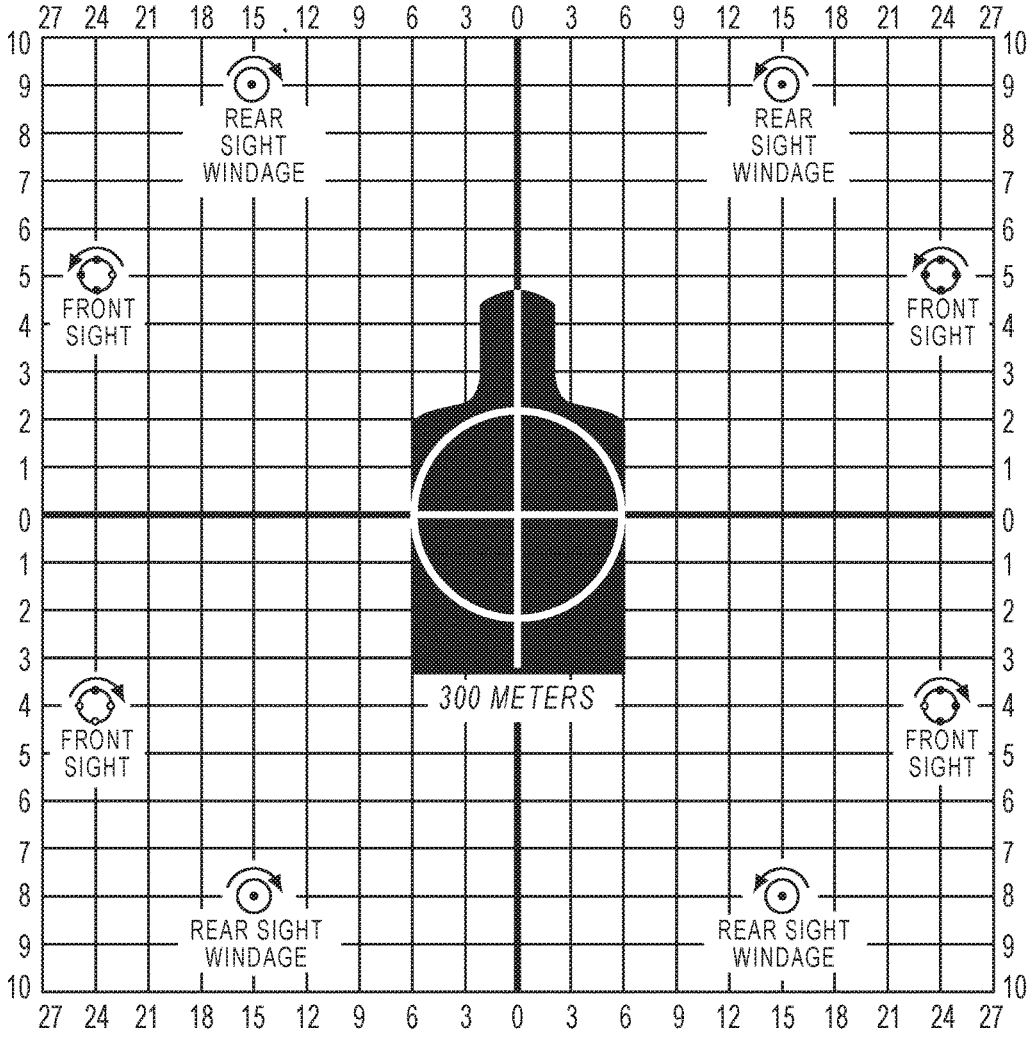

ZERO TARGET DATA

1- ROTATE REAR SIGHT ELEVATION KNOB TO THE 8/3 SETTING, THEN UP (RIGHT) ONE CLICK PAST THE 300 MARK, FOR ZEROING AT 25 METERS.

2- AIM AT TARGET CENTER, ADJUST SIGHTS TO MOVE SHOT GROUP CENTER AS CLOSE AS POSSIBLE TO THE WHITE DOT IN CENTER OF THE TARGET.

3- AFTER COMPLETION OF THE 25 METER ZERO, ROTATE THE REAR SIGHT ELEVATION KNOB BACK ONE CLICK TO THE 300/800 METER MARK, THE WEAPON WILL BE ZEROED FOR 300 METERS.

107

INSTRUCTIONS

Instructions when Using Aiming Laser

1. Select the type of film square to be used(IR laser or visible laser)
2. Place film square on target in accordance with guide provided on the target
3. Set target 25m from firing point
4. Aim the combat optic at the black printed square (POA*) in center of target. Adjust Laser windage and elevation so the aiming laser reflects off the film square
5. Fire a 5 round group. Rounds should strike inside POI** circle.

Instruction to Confirm Zero when Using Thermal Inline Sight

1. Place thermal square over the black printed square
2. Place target at desired distance
3. Aim at the thermal square (POA*) and fire a 5 round group. Adjust sight as needed

* POA point of aim
** POI point of impact

Figure 3

UNIVERSAL WEAPON ZEROING TARGET

CROSS-REFERENCE TO RELATED APPLICATIONS

The application claims benefit to U.S. Provisional Patent Application No. 62/345,864, filed Jun. 6, 2016, which is incorporated by reference herein in its entirety.

INCORPORATION BY REFERENCE

All publications, patents, and patent applications mentioned in this specification are herein incorporated by reference in their entirety as if each individual publication or patent application was specifically and individually indicated to be incorporated by reference in its entirety.

TECHNICAL FIELD OF THE DISCLOSURE

The present teaching relates to a system and method for manufacturing practice targets to zero a weapon equipped with an optical sight. In particular, a single practice target may be used for zeroing various types of weapon sights, such as, for example, laser sights, night vision sights, and thermal imaging sights, to ensure calibration of the weapon for accurate engagement of a real-life target.

BACKGROUND OF THE INVENTION

Many people use weapons for the benefit of civilians including law enforcement officers and members of the Army, Navy, Air Force, and Marines. In order to use a weapon effectively, a person must be able to accurately aim at a target. To accurately engage targets, the strike of a bullet must coincide with the aiming point (Point of Aim/Point of Impact) on the target. Over the years, various techniques and devices have been developed to help a person accurately aim a weapon. One common approach is to mount a sight on the weapon. A person then uses the sight to view an intended target. The sight must be zeroed before being used on the weapon. Namely, the users must calibrate their sights to their weapons to ensure they will hit their target. This is accomplished by adjusting the sights on the weapon to achieve a point of aim/point of impact. This zeroing process is one of the most critical elements of accurate target engagement. In order to aim accurately at a target, it is imperative for the sighting mechanism to be properly installed and adjusted on the gun. This is very important whenever the sight is disturbed in any way.

Initially when sight technology was developed, the most popular method to aim a weapon was using iron sights seen with the naked eye. Using traditional iron sights, the user fires at the center of a target having multiple lines and an image printed out on a medium, such as a piece of paper, similar to the target shown in FIG. 1. The group of shots should land at a predefined distance away from the target center depending on the weapon and sight characteristics. If the shots do not hit the target where expected, the sights must be adjusted so they will hit the target where they should.

As sights have become more common, a variety of weapon sights has been developed. For example, a person can today choose to use day sights, night vision sights, and thermal sights. In each of these categories, there are many options.

Although existing weapon sights have been generally adequate for their intended purposes, they have not been satisfactory in all respects. For example, sometimes it is difficult or impossible to see or detect the lines on the paper target of FIG. 1 with some sight technologies. Furthermore, laser aiming sights create an additional level of complexity for zeroing a weapon.

As an example to address this problem, targets were developed by Boyer, which is described in U.S. Pat. No. 7,528,397, and by Migliorini, which is described in U.S. Pat. No. 6,337,475, to provide effective means to zero a thermal weapon sight. The disadvantage of these type of sights is that they are calibrated specifically for thermal weapon sights. However, these targets do not work effectively with other sight technologies. If the user employs a sight different than the thermal weapon sight, accurate shot placement is compromised, because the target does not provide the correct aiming reference. Thus, the user is required to procure and inventory additional targets for other types of sights.

There is a need for an inexpensive target that is universally applicable to all situations and a variety of sights. There is a need for a single practice target device that can be employed with a variety of sights to ensure calibration of a weapon for accurately aim at a real-life target.

BRIEF SUMMARY OF THE INVENTION

The present invention may satisfy one or more of the above-mentioned desirable features. Other features and/or advantages my become apparent from the description which follows.

Various embodiments are directed to forming targets which may be used as training aides for weapons that are equipped with a sight. The present teaching is directed to a system and method for manufacturing a universal target for use with a variety of sights, such as, for example, laser sights, night vision sights, and thermal imaging sights, to quickly and accurately acquire a real-life target.

The invention in general comprises a physical object that can be used as a sign for, among other things, calibrating a variety of targeting scopes. It also provides a method of making such an object, and a method of calibrating a variety of different scopes using such an object. The invention thus provides an article of manufacture, which is a sign or target customizable with specialized film technologies, for example, such as near infrared retro-reflective film, white light retro-reflective film, thermal reflecting film, and photoluminescent film, for calibrating a variety of scope devices, as well as methods of making and using the article of manufacture.

In embodiments, the object is a sign that comprises a laminar member with a first and second surface. The first surface can comprise any one or more of a multitude of materials. It typically has the characteristic of interfacing properly with any materials adhered to it. In one embodiment, an exemplary target may consist of a paper printed with information and a single or multiple self-stick adhesive layers, such as stickers, that can be removably adhered to the paper target and used for field customizing the target for the user's specific shooting scenario. For example, in one embodiment, the target may include four self-stick adhesive layers. In other embodiments, the target may include more or less than four self-stick adhesive layers.

Each adhesive layer may be selected or designed to have a different film characteristic. Thus, in various embodiments, zeroing of a wide variety of different kinds of scopes may be accomplished using substantially the same target device since virtually unlimited numbers of adhesive layers can be designed and used to meet the specific needs of a particular scope protocol. For example, various embodiments of the device can be used across a wide range of scopes, because the different adhesive layers can consist of various specialized film technologies, including, but not limited to, for example:

Near Infrared Retro-Reflective Film can be used with night vision sights to identify a point of aim and with infrared (IR) aiming laser to position aiming lasers.

White Light Retro-Reflective Film: can be used with visible aiming laser to position aiming lasers.

Thermal Reflecting film can be used with thermal weapon sights to identify a point of aim.

Photo-luminescent film can be used with night vision sights to identify a point of aim without using infrared illumination by the shooter.

For the convenience of the user, in various embodiments, extensive data can be printed or provided on the target itself to assist the user with customizing the target for their specific use.

BRIEF DESCRIPTION OF THE DRAWINGS

The skilled artisan will understand that the drawings described below are for illustrative purposes only. The drawings are not intended to limit the scope of the present teachings in any way.

FIG. 1 (prior art) depicts a typical 25-meter calibration target for use with visible sights.

FIG. 3 shows an instruction sheet that can be used with the target of FIG. 2.

DETAILED DESCRIPTION OF PREFERRED EMBODIMENTS OF THE INVENTION

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" mechanism +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Figure 2:
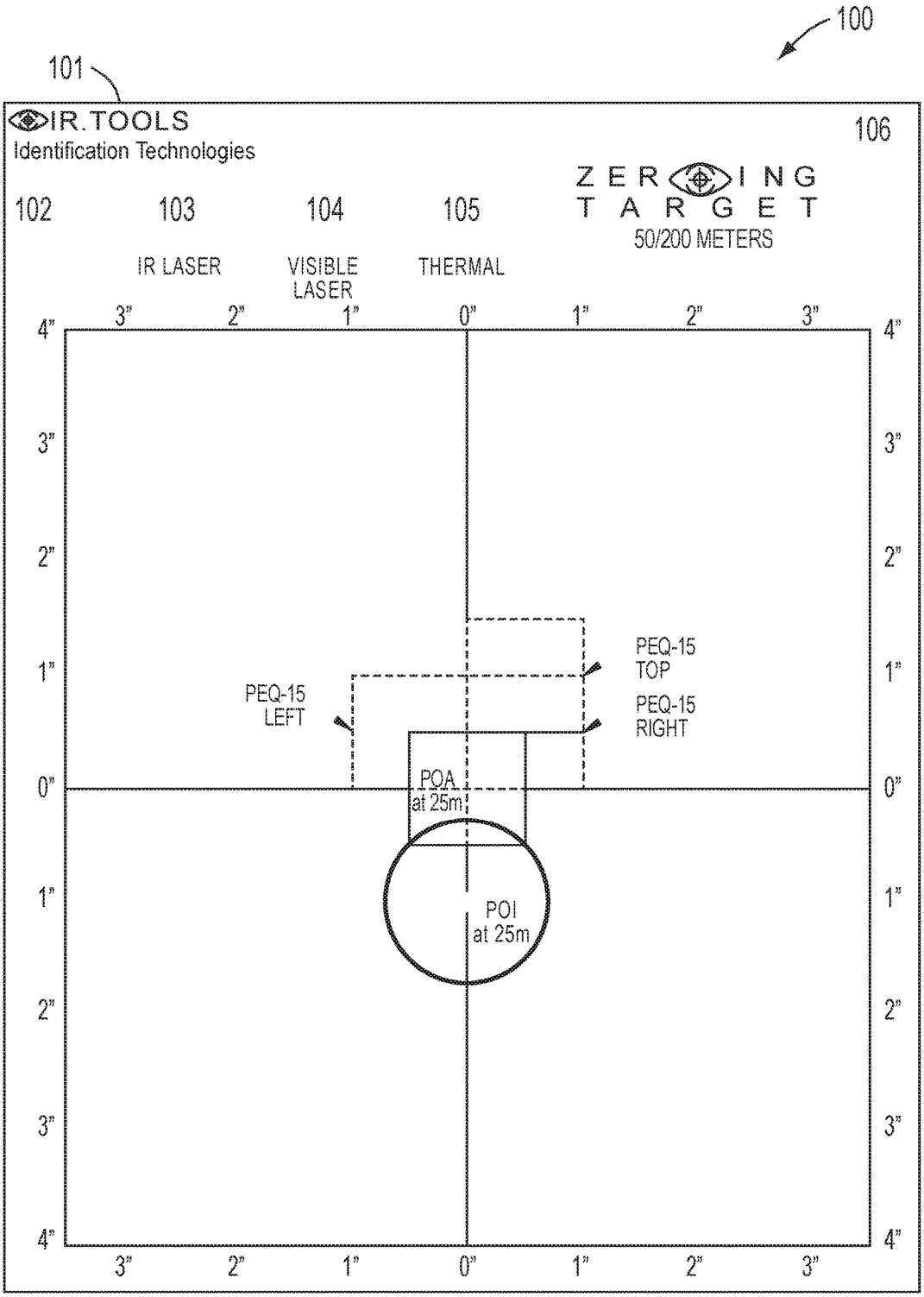
FIG. 2 is a front view of one embodiment of a target according to the present teachings.

An exemplary embodiment of a target 100 that can be used, for example, to zero or align a sight according to the present teachings is illustrated in FIG. 2. In the preferred embodiment, the target 100 can comprise multiple members. According to one preferred embodiment, the target 100 may consist of five laminar members 101, 102, 103, 104, 105 as depicted in FIG. 2. Laminar member 101 includes a first surface 106 and second surface 107 (FIG. 3). In various exemplary embodiments, such as, for example, in the exemplary embodiment of FIG. 2, the laminar member 101 can be a film, such as, for example, a polymer film or a paper. In the exemplary embodiments, the laminar member can be a paper approximately 8.5 inches by 11 inches and is resistant to water.

In an embodiment, laminar member 102 includes a first surface and second surface. The first surface can be, for example, photo-luminescent such that it can absorb energy from the environment and then release the energy again. The second surface can be adhesive so that it can be affixed to an appropriate location on the first surface 106 of laminar member 101. The photo-luminescent surface can be advantageous when using a night vision sight. The photo-luminescent surface can be used with night vision sights to identify a point of aim without the user having to use infrared illumination. In use, laminar member 102 can be placed in the center of the target at the point of aim (POA), and then charged using a light source. The POA is then easily visible by the shooter trying to zero his weapon. Laminar member 102 can be fabricated from readily available rolls or sheets of photo-luminescent film. In the preferred embodiment, a product based on Strontium Aluminate is preferred over one based on Zinc Sulfide.

In an embodiment, laminar piece 103 includes a first surface and second surface. The first surface is retro-reflective to near infrared energy (in a range of approximately 0.7 u to 3 u) only, such that it can retro-reflect incident near infrared energy and absorb visible light. The term "retro-reflection" should be understood to mean that incident energy is reflected back toward its source irrespective of the position of the reflector. The second surface has adhesive properties so that it can be affixed to an appropriate location on the first surface 106 of laminar member 101. This retro-reflective property provides another advantage when using a night vision sight. During use, laminar member 103 can be placed in the center of the target at the point of aim (POA). The shooter illuminates laminar member 103 with his infrared illuminator and then the POA is easily visible by the shooter trying to zero his weapon. Alternatively, laminar member 103 can be used with an infrared aiming laser to position the aiming laser. In such an embodiment, laminar member 103 is placed at a desired distance away from the POA such that, when the laser is focused exactly on laminar member 103, the weapon is aimed exactly at the POA. Laminar member 103 can be fabricated, for example, from readily available master rolls or sheets of infrared (IR) glow film, commonly known as, IR glint tape.

In the preferred embodiment, laminar member 104 includes a first surface and second surface. The first surface is retroreflective to white light. As defined above, retro-reflection means that incident energy is reflected back toward its source irrespective of the position of the reflector. The second surface has adhesive properties so that it can be affixed to an appropriate location on the first surface 106 of laminar member 101. Having a surface that is retroreflective to white light provides an additional advantage when using a night vision sight. The white light retro-reflective film can be used with a visible aiming laser to position the aiming laser. When in use, laminar member 104 can be placed in the center of the target at the point of aim (POA). The shooter illuminates laminar member 104 with his infrared illuminator and then the POA is easily visible by the shooter trying to zero his weapon. Alternatively, target 100 having a laminar member 104 with a surface that is retroreflective to white light can be used with an infrared aiming laser. In such an exemplary embodiment, laminar member 104 is placed at a desired distance away from the POA such that when the laser is focused exactly on laminar member 104, the weapon is aimed exactly at the POA. In an example, laminar member 104 can be readily fabricated, for example, from master rolls or sheets of retroreflective film.

In an embodiment, laminar piece 105 includes a first surface and second surface. The first surface is reflective to thermal energy (in a range of approximately 3 u to 12 u) and also has the characteristic of very low emissivity (emissivity value of about 0.4 or less). The second surface has adhesive properties so that it can be affixed to an appropriate location on first surface 106 of laminar member 101. This thermal reflective attribute provides an advantage using a thermal sight. The thermal reflecting film can be used with thermal weapon sights to identify the point of aim (POA). In use, laminar member 105 can be placed in the center of the target at the POA. When viewed with the thermal sight, the POA will then appear to exhibit a different temperature than the surrounding paper, providing a convenient way to find the POA. In an exemplary embodiment, laminar member 105 can be readily fabricated from master rolls or sheets of no power film, such as, for example, AKA thermal film, thermal target film, or low emissivity film.

In various embodiments, laminar members 102, 103, 104, 105, having adhesive release properties, such as stickers, can initially be placed on a certain area of first surface 106 of laminar member 101. This adhesive property allows the laminar members to be easily removed and placed permanently in the appropriate locations.

Namely, in various embodiments a laminar target 101 is provided having a first surface 106 and a second surface 107 bearing multiple pieces of film 102-105, each having first and second surfaces and various optical properties, enabling the user to calibrate a variety weapon sighting technologies, including night vision, thermal imaging, and aiming lasers, using a single device. The multiple pieces of film 102-105 are covered with adhesive on the second surface and adhered to the first surface of the target such that they can be repositioned.

In some embodiments of the zeroing process, not all laminar members 102-105 may be used for each zeroing operation. In some embodiments, one laminar member or a combination of selective laminar members may be employed for a specific application.

As depicted in FIGS. 2-3, first surface 106 and second surface 107 can be positioned below the target grid and printed to include an instruction sheet listing instructions and data for the user to aid them in how to use the target and where to place the appropriate components.

In various embodiments, laminar member 101 can be made using standard printing arts including screen printing, digital printing, and offset printing. The inks do not require any special characteristics compared to the most commonly used black inks. A design consisting of words, graphics, or any other creation can be printed on the first surface 106, the second surface 107 or a combination thereof. For example, on the first surface 106, a 25 Meter Zeroing Target or any other object or pattern of interest may be printed. An exemplary sample target appears in FIGS. 1 and 2. The printing has the characteristic of being the proper thickness and type such that design on the printed locations on the surface(s) when viewed through a variety of sight devices will be readily apparent. Using this invention, any conceivable design can be created using traditional printing means, such as a silk screening. It should be understood that any technology used to print and any design falls within the scope of this patent.

In an alternate embodiment, one or more of laminar members 102-105 may be eliminated from target 100 if any of these laminar members are not required for certain applications.

Figure 4:
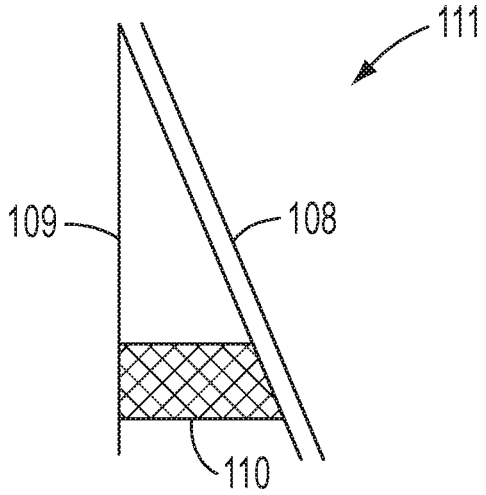
FIG. 4 illustrates an alternative embodiment of a thermal reflective member according to the present teachings.

In another alternate embodiment as illustrated in FIG. 4, laminar member 105 can be replaced with a non-laminar member 111 that is configured having, for example, a triangular shape. In this example, the non-laminar member 111 is depicted as a triangular shape, but it is clear that any shape can be used, such as rectangular, square, and the like. Non-laminar member 111 is comprised of members 108, 109, and 110. Member 108 is a thermally reflective film, similar to laminar member 105. Member 108 is permanently adhered to member 109, which is a laminar that is folded over to form a hinge. In the preferred embodiment, member 109 is a folded paper or polymer film. Member 110 is a space filling component configured to maintain an angle in member 109. For example, in the preferred embodiment, member 109 may be configured to maintain an angle approximately within a range of 5 degrees to 30 degrees. In some embodiments, even more preferable, member 109 may be configured to maintain an angle approximately within a range of 10 degrees to 20 degrees. In one embodiment, member 110 is a compressible elastic material that allows member 111 to compress to be flat for packaging, and expand at a predetermined angle during use. In various embodiments, member 110 is an elastomeric foam with adhesive provided on two surfaces.

Member 111 is configured to be superior to laminar member 105 in its ability to provide greater thermal difference in comparison to first surface 106. In yet a further additional alternate embodiment, member 110 may be omitted from the target. In such an embodiment, the user may adjust member 109 to an optimal angle during use. For example, in the preferred embodiment, member 109 may be configured to maintain an angle approximately within a range of 5 degrees to 30 degrees. In some embodiments, even more preferable, member 109 may be configured to maintain an angle approximately within a range of 10 degrees to 20 degrees.

Namely, in various embodiments, a laminar target is provided having a first and second surface bearing multiple pieces of film, each having first and second surfaces and various optical properties, enabling the user to calibrate a variety weapon sighting technologies, including night vision, thermal imaging, and aiming lasers, using a single device. The multiple pieces of film are covered with adhesive on the second surface and adhered to the first surface of the target such that they can be repositioned. The piece of film detectable with thermal weapon sight has a triangular cross-section causing its first surface to sit at an angle with respect to the first surface of the laminar target.

In an example prepared according to the present teachings, a target was printed on Rite in the Rain paper having a standard letter size of 8½ inches wide by 11 inches long. The photo-luminescent member was cut from Jessup Manufacturing part 7560. The IR retro-reflective member was cut from IR.Tools film. The white light reflective member was cut from Orafol retroreflective film. The thermal film part member was cut from IR. Tools film CID-THRM-T4166. Each of the film members was adhered to the target using a glue dot between its release liner and the target.

Figure 5:
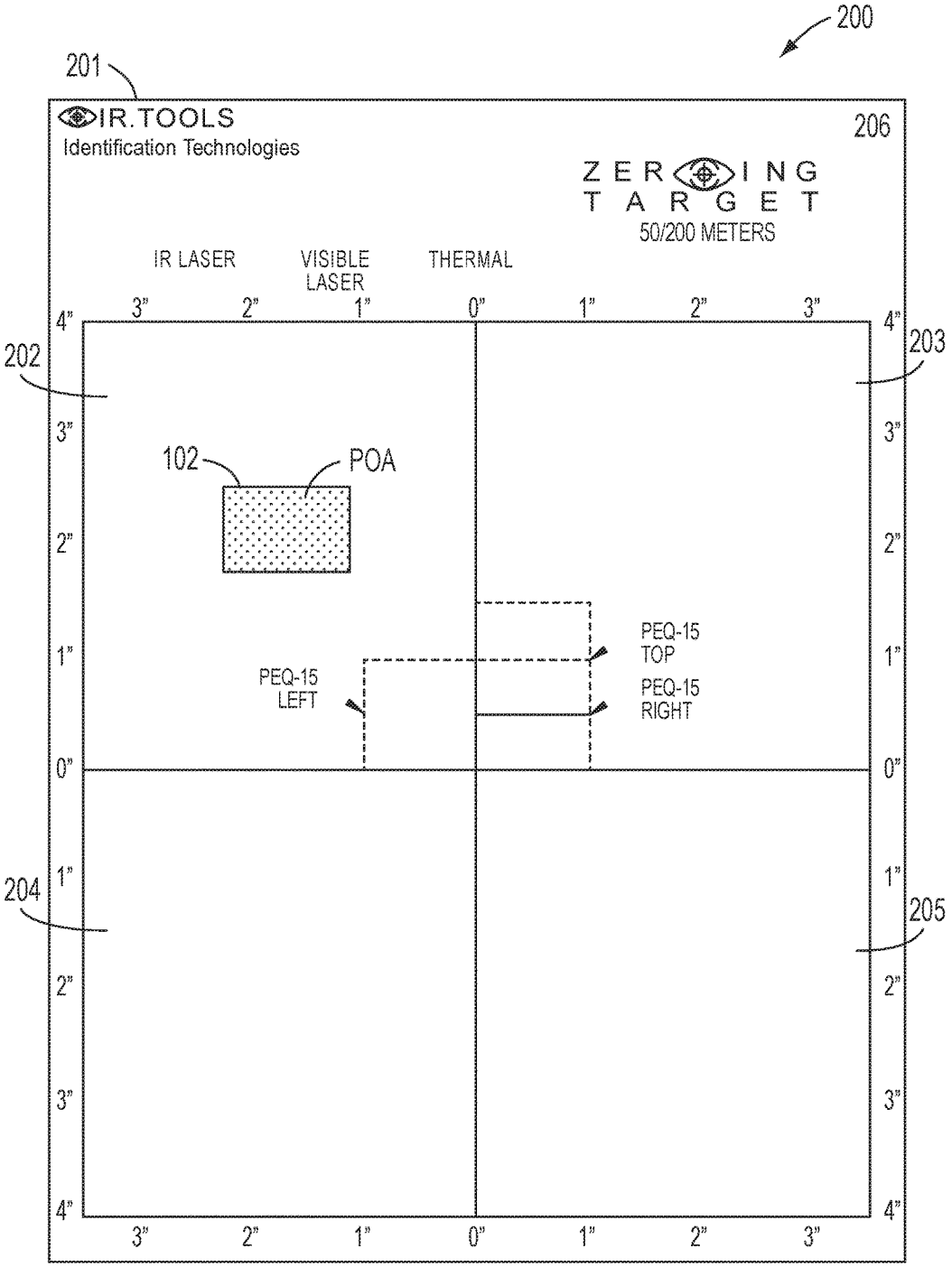
FIG. 5 depicts another exemplary embodiment of a target according to the present teachings.

In another embodiment, a universal target 200 that can be used to zero a variety of sights, such as, for example, laser sights, night vision sights, and thermal imaging sights, is illustrated in FIG. 5. Target 200 is preferably a laminar member 201 including a first surface and a second surface. The fist surface 206 is shown having various optical properties that are divided into four quadrants 202, 203, 204, 205. Each quadrant is designed having a different optical property so that each quadrant is associated with one optical property. By way of example, quadrant 202 is configured similar to laminar member 102 having a photo-luminescent film that can be used with night vision sights to identify a point of aim without using infrared illumination by the shooter. Quadrant 203 is configured similar to laminar member 103 having a near infrared retro-reflective film that can be used with night vision sights to identify a point of aim and with infrared (IR) aiming laser to position aiming lasers. Quadrant 204 is configured similar to laminar member 104 having a white light retro-reflective film that can be used with visible aiming laser to position aiming lasers. Quadrant 205 is configured similar to laminar member 105 having a thermal reflecting film that can be used with thermal weapon sights to identify a point of aim.

By way of example with respect to quadrant 202 and laminar member 102, in operation, the shooter uses a light source to charge laminar member 102, which may be provided, for example, at a center location or any other location within quadrant 202 at the point of aim. The point of aim is then easily visible within quadrant 202 by the shooter trying to zero his weapon. Those having skill in the art would recognize that laminar member 200 may be divided into quadrants having more or less than the four quadrants as depicted in FIG. 5.

It will be apparent to those skilled in the art that various modifications and variations can be made to the system and method of the present disclosure without departing from the scope its teachings.

Other embodiments of the disclosure will be apparent to those skilled in the art from consideration of the specification and practice of the teachings disclosed herein. It is intended that the specification and examples be considered as exemplary only.

What is claimed is:

1. A laminar target comprising:

a first surface and a second surface bearing multiple pieces of film attached to a single device;

each film having a first film surface and a second film surface; and the first film surface of each film having a different optical property, enabling calibration of a variety weapon sighting technologies, including a night vision sight, a thermal imaging sight, and an aiming laser sight, using the single device;

wherein at least one of the multiple pieces of film is detectable with the thermal imaging sight and has a triangular cross-section defining an angle with respect to the first surface of the laminar target.

2. The target of claim 1, wherein the multiple pieces of film are covered with adhesive on the second film surface and adhered to the first surface of the target such that the multiple pieces of film can be repositioned.

3. The target of claim 1, wherein at least one of another piece of the multiple pieces of film comprises a near infrared retro-reflective film for use with the night vision sight to identify a point of aim.

4. The target of claim 1, wherein at least one of another piece of the multiple pieces of film comprises a near infrared retro-reflective film for use with the aiming laser sight to position an aiming laser.

5. The target of claim 1, wherein at least one of another piece of the multiple pieces of film comprises a white light retro-reflective film for use with a visible aiming laser sight to position an aiming laser.

6. The target of claim 1, wherein the at least one of the multiple pieces of film comprises a thermal reflecting film for use with the thermal imaging sight to identify a point of aim.

7. The target of claim 1, wherein at least one of another piece of the multiple pieces of film comprises a photo-luminescent film for use with the night vision sight to identify a point of aim without a use of an infrared illumination.

8. The target of claim 1, wherein the angle with respect to the first surface of the laminar target is within a range of approximately 5 degrees to 30 degrees.

9. The target of claim 1, wherein the multiple pieces of film comprise a laminar member.

10. The target of claim 1, wherein some of the multiple pieces of film comprises a laminar member and the at least one of the multiple pieces of film comprises a non-laminar member.

11. The target of claim 10, wherein the non-laminar member comprises a multiple member structure including a thermally reflective film, a folded laminar member, and a space filling member.

12. The target of claim 11, wherein the thermally reflective film is permanently adhered to the folded laminar member to form a hinge and the space filling member is configured to maintain the angle of the folded laminar member.

13. A laminar target comprising:

a first surface and a second surface including a plurality of quadrants and multiple pieces of film configured within a single device; and each quadrant having a piece of film with a different optical property, enabling calibration of a variety weapon sighting technologies, including a night vision sight, a thermal imaging sight, and an aiming laser sight, using the single device;

wherein one of the multiple pieces of film is a multiple member structure that is detectable with a weapon sight and has a triangular cross-section defining an angle with respect to the first surface of the laminar target, and the multiple member structure includes a reflective film, which is adhered to a folded member to form a hinge and a space filling member is configured to maintain the angle of the folded member.

14. The target of claim 13, wherein at least one of the multiple pieces of film comprises a near infrared retro-reflective film for use with the night vision sight to identify a point of aim.

15. The target of claim 13, wherein at least one of the multiple pieces of film comprises a near infrared retro-reflective film for use with the aiming laser sight to position an aiming laser.

16. The target of claim 13, wherein at least one of the multiple pieces of film comprises a white light retro-reflective film for use with a visible aiming laser sight to position an aiming laser.

17. The target of claim 13, wherein at least one of the multiple pieces of film comprises a thermal reflecting film for use with the thermal imaging sight to identify a point of aim.

18. The target of claim 13, wherein at least one of the multiple pieces of film comprises a photo-luminescent film for use with the night vision sight to identify a point of aim without a use of an infrared illumination.

19. The target of claim 13, wherein the multiple pieces of film comprise a near infrared retro-reflective film, a white light retro-reflective film, a thermal reflecting film, and a photo-luminescent film.

20. The target of claim 13, wherein some of the multiple pieces of film comprises a laminar member and the one of the multiple pieces of film comprises a non-laminar member; and wherein the non-laminar member includes a thermally reflective film that is permanently adhered to a folded laminar member to form the hinge and the space filing member is configured to maintain the angle of the folded laminar member.

21. A laminar target comprising:

a first surface and a second surface bearing multiple pieces of film attached to a single device;

each film having a first film surface and a second film surface; and the first film surface of each film having a different optical property, enabling calibration of a variety weapon sighting technologies, including a night vision sight, a thermal imaging sight, and an aiming laser sight, using the single device;

wherein one of the multiple pieces of film is a multiple member structure that is detectable with the thermal imaging sight and has a cross-section defining an angle with respect to the first surface of the laminar target, and the multiple member structure includes a thermally reflective film, which is adhered to a folded member to form a hinge configured to maintain the angle of the folded member.

* * * * *